United States Patent [19]

Pundak et al.

[11] Patent Number: 4,514,987

[45] Date of Patent: May 7, 1985

[54] PASSIVE AUTOMATIC PHASE DELAY CONTROL OF THE DISPLACER MOTION IN PNEUMATICALLY DRIVEN SPLIT CYCLE TYPE CRYOCOOLERS

[75] Inventors: Nachman Pundak, Kibbutz Eyn Charod; Shmuel Shtrikman, Rechovot, both of Israel

[73] Assignee: Ricor Ltd., Israel

[21] Appl. No.: 495,429

[22] Filed: May 17, 1983

[30] Foreign Application Priority Data

May 25, 1982 [IL] Israel ..... 65881

[51] Int. Cl.[3] ..... F25B 9/00

[52] U.S. Cl. ..... 62/6; 62/3; 277/80

[58] Field of Search ..... 62/3, 6; 277/80

[56] References Cited

U.S. PATENT DOCUMENTS

| | | | |
|---|---|---|---|
| 3,254,745 | 6/1966 | Isakov et al. | 277/80 |
| 3,343,009 | 9/1967 | Wagini et al. | 62/3 |
| 3,364,675 | 1/1968 | Dorer | 62/6 |
| 3,413,814 | 12/1968 | VanGuens | 62/3 |
| 3,612,549 | 10/1971 | Berkowitz | 277/80 |
| 3,659,306 | 5/1972 | Stoltze et al. | 277/80 |
| 3,774,404 | 11/1973 | Walker et al. | 62/3 |
| 3,774,405 | 11/1973 | Leo | 62/6 |
| 4,355,519 | 10/1982 | Kercheval et al. | 62/6 |

*Primary Examiner*—Ronald C. Capossela

*Attorney, Agent, or Firm*—Toren, McGeady, Stanger, Goldberg & Kiel

[57] ABSTRACT

In order to control the passive motion of the pneumatically driven displacer in a cryogenic cooler system of the split cycle type, the refrigerant gas is forced to flow through a narrow passage within the pneumatic pillow in a manner that the gas during that passage is in viscous friction with the wall of the passage.

6 Claims, 2 Drawing Figures

PASSIVE AUTOMATIC PHASE DELAY CONTROL OF THE DISPLACER MOTION IN PNEUMATICALLY DRIVEN SPLIT CYCLE TYPE CRYOCOOLERS

FIELD AND BACKGROUND OF INVENTION

The present invention relates to cryogenic coolers, and more particularly to the passive movement control of the displacer in coolers of the split cycle type.

Cryogenic coolers are employed in a number of fields, e.g. electro-optics, electronics, vacuum techniques etc. Constructions of such coolers comprise two basic constituents: a compression—and an expansion unit. Some of these coolers operate on a closed circuit scheme and the passage of the gas used occurs from compression stage to expansion without use of valves. A typical example is the Stirling cycle and those designed similar to it.

There is a well known group of coolers of split build, i.e. the compression—and the expansion stage being strictly distinct and being connected only by gas conducting conduits. In this type of coolers the operation of the expansion unit is by pneumatic, or electric or motor drive. The principle of the function of the expansion unit is based on change of volume of an expansion cell which occurs periodically and under phase difference in relation to pressure pulses acting on the said cell. The creation of a proper phase differential between the volume and pressure pulses is imperative.

In pneumatically driven split cycle coolers the change of volume of the expansion space is obtained by means of a pneumatic drive which is actuated by the same source of pressure pulses which acts on the expansion space, it is necessary to provide means ensuring the creation of the necessary phase differential. This differential is in the range of 80°–120°, so as to ensure maximal efficiency.

STATE OF ART

The means conventionally used in obtaining the said phase differential are:

(a) introduction of a source of friction of mechanical kind intermediate the expansion unit body and the displacer which by its movement causes the change of the expansion space. In this case the movement of the displacer is delayed until the pressure pulse which is being built up is great enough to overcome the static friction. Such a means usually consists of a packing between displacer and the body of the expansion unit. The innate disadvantage of such means resides therein that the coefficient of friction of a packing is not constant and is apt to change in the course of time, due to wear and tear, which are likely to cause changes in the phase differential and consequently reduce the potential of the cooler, (b) the employ of hydraulic friction means, by pressure drop which is reached in the regenerator. Such pressure drop creates a drag which causes retardation of the movement of the displacer. Where pressure pulses are of sinusoidal character and the movement of the displacer is solely subject to pneumatic forces it is usually possible to bring about a phase difference of 90°, as would be required for a proper performance. The disadvantage of this method resides therein that the regenerator has to be designed in such a manner that the hydraulic resistance would permit attaining an optimal movement, without laying stress on getting maximal thermic exploitation of the regenerator. Such a regenerator would be much more compact as would be required by thermic considerations only, and would be exposed to stoppage to a greater extent.

To overcome the above mentioned disadvantage the use of a gap seal rather than a conventional seal has been suggested. The disadvantage of this method resides therein that on the one hand the resistance of the regenerator must be increased in order to keep the phase difference, on the other hand, the said increased resistance is doing ill the working conditions of the gap seal.

OBJECT OF THE INVENTION

It is the object of this invention to provide a method and a means for controlling the passive motion of the pneumatically driven displacers for creation of the necessary phase differential.

SHORT SUMMARY OF THE DISCLOSURE

It has now been found that the necessary phase differential would be attainable by making use of viscous friction of the gas during its passage from one side of the pneumatic pillow to its other side and vice versa by forcing the gas through a constrictive passage wherein the viscous damping is created. In order to achieve this—without encountering the above mentioned disadvantages—the displacer used in a system according to the invention is physically connected with a solid body which divides the pneumatic pillow into two chambers, communicating with one another via an extremely narrow gap.

In a preferred and practical embodiment, the said body is cup shaped.

Another way or a better effect of such an arrangement may be achieved by placing the displacer and the body connected with it in a magnetic field created by permanent or by electric magnets in which case the said body consists of electrically high conductive material. In such case the movement of the displacer and the said conducting body create periodical changes of magnetic flux in the conductive body and the creation of current within it. Now, if the conductive body is in the shape of a cup—eddy currents will come into existence followed by mechanical drag which relatively correspond with the created current and the change of magnetic flux in the conductor. The mechanical drag obtained is in direct relation with the speed of movement of the displacer. In the case of movement of a displacer of sinusoidal periodical character the speed is at a lag of 90° as against the movement which means that without further means the coveted differential comes into existance, provided that the magnetic damper is adequately designed.

SHORT DESCRIPTION OF DRAWINGS

The invention will now be described in detail with reference to the annexed drawings wherein:

FIG. 1 is a cross section of the expansion unit, while FIG. 2 is the same unit in a second embodiment.

DESCRIPTION OF PREFERRED EMBODIMENTS

Figure 1:
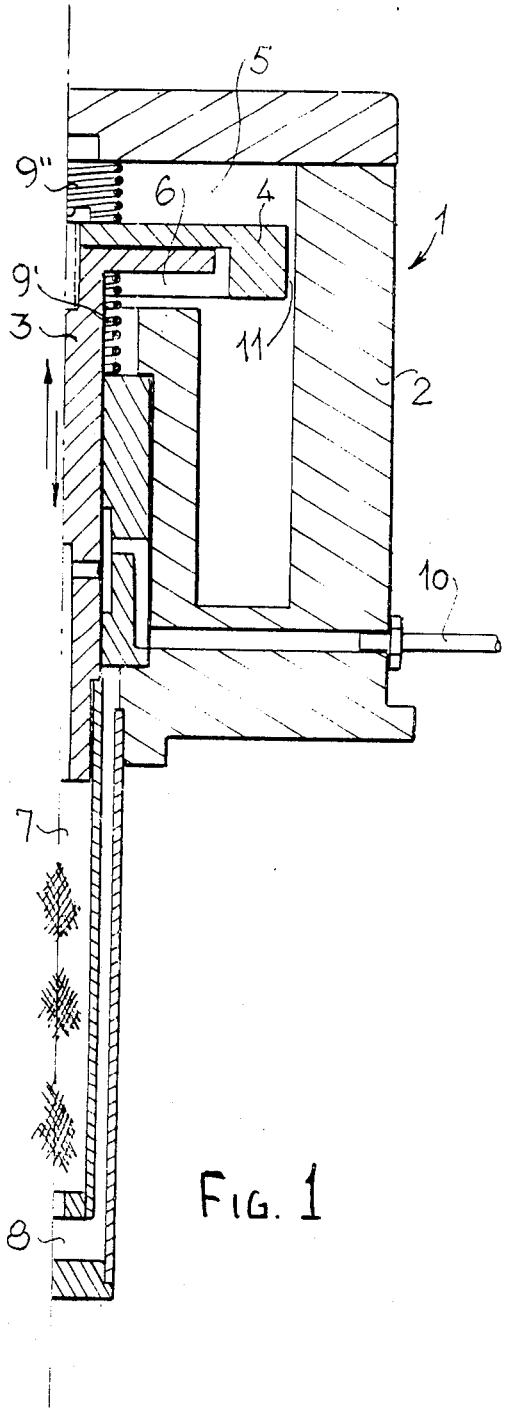

Turning first to FIG. 1 the expansion unit 1 is composed of the following constituents: An outer casing 2, the displacer 3 onto which is connected a solid body 4, which divides the pneumatic pillow or volume into two chambers 5 and 6, and regenerator 7 which can move within the space 8 of the expansion chamber. At the opposite side of the displacer are positioned two helical springs 9' and 9'' (which—however—could be dispensed with). The unit as a whole is connected with a compressor (not shown) by means of a gas conduit 10.

The arrangement functions in the following manner: Gas arriving from the compressor by way of conduit 10 passes in the conventional way into the inner space of the regenerator 7. As soon as pressure overcomes the bias of the displacer 3—which is connected with the body 4—it starts moving as indicated by arrow X. The gas trapped within the pneumatic pillow in chamber 5 is forced to pass through the constrictive passage 11 wherein the viscous damping is created and vice versa.

Figure 2:
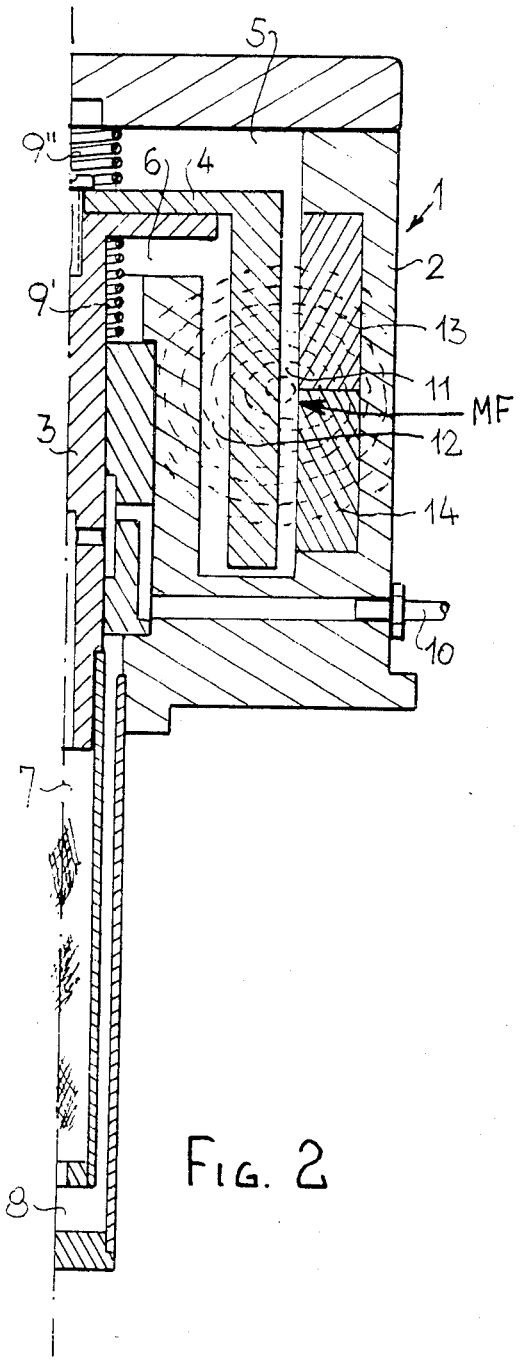

It is quite apparent that the greater the viscous friction the greater phase delay is achieved, thus according to a preferred embodiment the said body 4 is larger and cup shaped as can be seen in FIG. 2. In this embodiment the viscous friction is created all along passages 11 and 12.

In yet another embodiment, two permanent magnets 13 and 14 (FIG. 2) are positioned within the outer casing 2, and cup 4 consists of electrically highly conductive material. This arrangement functions basically in the same manner as indicated above, the conductive body 4 moves within a magnetic field MF created by the permanent magnets 13 and 14 causes a change in the magnetic period flux in the body 4 and creates current within it. Due to the shape of the said body 4 an eddy circuit is created, due to which—in turn—a mechanical drag becomes evident which is proportional to the electric current which had been created and the speed of magnetic flux change in the conductive body 4.

The above function of the device according to FIG. 2 is based on the use of permanent magnets or of electromagnets and may be put into practice in various ways, all of which would be within the scope of the invention:

1. The magnetic field may be positioned at the exterior or within the vibrating conductor 4, i.e. the position of the magents may be different.

2. The conductor 4 might be static, while the magnetic field vibrates.

3. The conductor 4 may be of the shape described and shown in the drawing, but could be a coil the resistance of which is variable, whereby the degree of drag would vary.

4. The spring 9' and 9'' serving only to: (a) suspend inertial forces, (b) centering the motion of the average but could also be dispensed with.

5. Means could be provided to "soften" the movement of the displacer, e.g. perforations for equalisation of pressure at the ends of the strokes, energy absorbing means at those ends and the like.

It will be seen that in a device as described the inertial force must be well balanced relative to the returning spring and between the magnetic retarding force and the pneumatic drive. A proper designing warrants a full control of the drag at the angle of performance and degree of amplitude of movements.

We claim:

1. A method of passive automatic phase delay control of the motion of a displacer in pneumatically driven split cycle type cryocoolers including a pneumatic volume and an expansion cell in which the volume changes periodically under phase difference in relation to pressure pulses acting on said cell, for establishing a phase differential between the volume and the pressure pulses, comprising the steps of dividing the pneumatic volume into separate interconnected chambers containing a refrigerant gas, forming a constrictive passage between the chambers, forcing the refrigerant gas from one chamber into the other through the constrictive passage so that the gas flows in viscous friction with the surfaces defining the constrictive passage.

2. A split cycle type cryocooler system comprising an expansion cell and walls forming a pneumatic volume, a displacer located within and dividing the volume into separate chambers in communication within said volume through a constrictive passage, said displacer being displaceable within said volume for varying the volume of said chambers where the volume changes periodically under the phase difference in relation to pressure pulses acting on said expansion cell, to said displacer is attached an electrically conductive body, means incorporated into said pneumatic volume for forming a magnetic field so that said electrically conductive body is located in the magentic field whereby eddy current is created and mechanical drag is produced by the displacement of said displacer.

3. A split cycle type cryocooler system, as set forth in claim 2, wherein said displacer includes a cup-shaped member located within said pneumatic volume and dividing said pneumatic volume into said chambers, and said cup-shaped member having surfaces thereon spaced closely inwardly from the surfaces defining said pneumatic volume forming therebetween said constrictive passage between said chambers.

4. A split cycle type cryocooler system, as set forth in claim 2, wherein to said displacer is attached a permanent magnet which creates eddy current and mechanical drag when driven in an electrical conductor envelope.

5. A split cycle type cryocooler system comprising an expansion cell including walls forming a pneumatic volume, a solid body attached to the displacer located within and dividing said volume into separate chambers in communication through a constrictive passage, where the volume change periodically under phase difference in relation to pressure pulses acting on said expansion unit, said displacer includes a solid body located within said volume and forming the division of the pneumatic volume into the separate chambers, said walls forming said pneumatic volume having inside surfaces, said solid body being spaced closely inwardly from said inside surfaces for forming the constrictive passage between said chambers, so that the gas within said pneumatic volume passing between the chambers through the constrictive passage creates a mechanical drag force.

6. A split cycle type cryocooler system, as set forth in claim 5, wherein said solid body is a piston-shaped body attached to said displacer and extending transversely of the direction of movement of said displacer within said pneumatic volume and forming the division of said pneumatic volume into two separate chambers in communication through said constrictive passage.

* * * * *